US007777713B2

(12) United States Patent
Hashimoto et al.

(10) Patent No.: US 7,777,713 B2
(45) Date of Patent: Aug. 17, 2010

(54) DEVICE AND METHOD FOR DRIVING LARGE-SIZED AND HIGH-RESOLUTION DISPLAY PANEL

(75) Inventors: Yoshiharu Hashimoto, Kanagawa (JP); Hiroshi Hayama, Kanagawa (JP); Toru Kume, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 978 days.

(21) Appl. No.: 11/580,112

(22) Filed: Oct. 13, 2006

(65) Prior Publication Data

US 2007/0085798 A1 Apr. 19, 2007

(30) Foreign Application Priority Data

Oct. 14, 2005 (JP) ..... 2005-299650

(51) Int. Cl.
*G09G 3/36* (2006.01)

(52) U.S. Cl. ..... 345/100; 345/99

(58) Field of Classification Search ..... 345/99, 345/100, 204
See application file for complete search history.

(56) References Cited

U.S. PATENT DOCUMENTS 5,600,345 A * 2/1997 Dingwall et al. ..... 345/100
5,642,127 A * 6/1997 Tamai ..... 345/95
5,751,279 A * 5/1998 Okumura ..... 345/212
6,812,908 B2 * 11/2004 Lim ..... 345/87
2003/0179165 A1 * 9/2003 Park et al. ..... 345/77
2004/0021625 A1 * 2/2004 Lee ..... 345/87
2006/0187175 A1 * 8/2006 Lo et al. ..... 345/100

FOREIGN PATENT DOCUMENTS

JP 2004-126581 A 4/2004
JP 2005-4205 A 1/2005

* cited by examiner

*Primary Examiner*—Chanh Nguyen
*Assistant Examiner*—Jonathan Blancha
(74) *Attorney, Agent, or Firm*—Sughrue Mion, PLLC

(57) ABSTRACT

A display device is provided with a display panel, a data line driving circuitry, and a scan line driving circuitry. The display panel includes: a plurality of data lines extending in a column direction; a plurality of scan lines extending in a row direction; a plurality of pixels disposed at respective intersections of the plurality of data lines and the plurality of scan lines, and a dummy data line arranged in parallel to the plurality of data lines. The data line driving circuitry drives the plurality of data lines and the dummy data line. The scan line driving circuitry drives the plurality of scan lines. The data line driving circuitry feeds a dummy signal to the scan line driving circuitry through the dummy data line. The scan line driving circuitry drives the scan lines in response to the dummy signal.

7 Claims, 8 Drawing Sheets

DEVICE AND METHOD FOR DRIVING LARGE-SIZED AND HIGH-RESOLUTION DISPLAY PANEL

BACKGROUND OF THE INVENTION

1. Field of the Invention

The present invention relates to a display device, a data driver IC, a gate driver IC and a scan line driving circuitry, in particular, a method of driving a large-size and high-resolution display panel.

2. Description of the Related Art

In recent years, display panel devices have become widely used in various electronic devices that require lower operating voltage, lower power consumption, and reduced size and weight. In particular, liquid crystal display devices, which are advantageous in terms of reduced power consumption, weight and size, compared to other display devices, have been adopted as display devices in various electronic appliances, such as televisions and personal computer monitors.

One typical liquid-crystal display device is the active matrix liquid crystal display device (AMLCD), which incorporates active elements such as TFT (Thin Film Transistor) in pixels. An active matrix liquid crystal display panel is typically composed of a set of data lines arranged in a column direction and a set of scan lines arranged in a row direction, and pixels including TFT disposed at respective intersections of the data lines and the scan lines. The data lines are driven by a data line driver, and the scan lines are driven by a scan line driver.

Recent requirements imposed on the liquid crystal display device include larger viewing area size and higher resolution. However, larger viewing area size and higher resolution undesirably causes variations in the pixel brightness depending on the positions on the liquid crystal display panel, since larger viewing area size and higher resolution enhance delays of the signals fed to pixels located away from the data line driver and the scan line driver, due to the capacitance and resistance of the data lines and the scan lines. Especially, one issue is the difference in brightness and contrast between the pixels located close to the data line driver and the scan line driver and the pixels located away from the data line driver and the scan line driver, which causes deformation of a displayed image.

Japanese Laid Open Patent Application No. 2005-004205 discloses a liquid crystal display device configured to avoid deterioration of display images due to the signal delay on the scan lines, which controls the timing of outputting display signals from the data line driver, and thereby applies the display signals and the associate scan signal outputted from the scan line driver to the associated pixels substantially at the same time.

FIG. 6 is a block diagram of the liquid crystal display device disclosed in the above-mentioned patent application, which is denoted by the numeral 100. The liquid crystal display device 100 is composed of a liquid crystal display panel 11, a data line driving circuitry 12 and a scan line driving circuitry 13. Provided on the liquid crystal display panel 11 are a plurality of data lines $X_1$ to $X_m$ (m is a natural number of 2 or more), a plurality of scan lines $Y_1$ to $Y_n$ (n is a natural number of 2 or more), pixels $P_{11}$ to $P_{mn}$ each including a TFT 11*c*. It should be noted that FIG. 6 shows only four pixels $P_{11}$, $P_{1n}$, $P_{m1}$ and $P_{mn}$ for simplicity of the figure. The data lines $X_1$ to $X_m$ are arranged to extend in the column direction, and the scan lines $Y_1$ to $Y_n$ are arranged to extend in the row direction. The pixels $P_{11}$ to $P_{mn}$ are disposed at respective intersections of the data lines $X_1$ to $X_m$ and the scan lines $Y_1$ to $Y_n$. The gate electrodes of the TFTs 11*c* within the pixels $P_{11}$ to $P_{mn}$ are connected to the scan lines $Y_1$ to $Y_n$ on nodes $\mathbf{15}_{11}$ to $\mathbf{15}_{mn}$, respectively, and the drain electrodes are connected to the data lines $X_1$ to $X_m$ on nodes $\mathbf{14}_{11}$ to $\mathbf{14}_{mn}$.

The liquid crystal display panel 11 additionally includes an output instruction line 17 arranged in parallel to the scan lines $Y_1$ to $Y_n$. As will be described later, the output instruction line 17 is used to control timings of driving the data lines $X_1$ to $X_m$.

The data line driving circuitry 12 is provided with a timing controller 16 and data driver ICs $\mathbf{12}_1$ to $\mathbf{12}_p$ used to output display signals onto the data lines $X_1$ to $X_m$. The data driver ICs $\mathbf{12}_1$ to $\mathbf{12}_p$ receive an output instruction signal TP from the timing controller 16 through the output instruction line 17, and the output timings of the data drive signals onto the data lines $X_1$ to $X_m$ are controlled in response to the output instruction signal TP. Specifically, the output instruction signal TP is delayed by the output instruction line 17 due to the capacitance and resistance thereof, and this allows the data driver ICs $\mathbf{12}_1$ to $\mathbf{12}_p$ to receive the output instruction signal TP at delayed timings depending on the distance from the scan line driving circuitry 13. Therefore, the liquid crystal display device 100 effectively reduces the timing lag between the display signals and the scan signals at positions away from the scan line driving circuitry 13.

This conventional technique, however, does not sufficiently deal with the delay of the display signals and the waveform distortion of the scan signals; this conventional technique only addresses dealing with the delay of the scan signals.

Specifically, as shown in FIG. 7A, the capacitance and resistance of the output instruction line 17 causes delay and waveform distortion of the output instruction signal TP within the conventional liquid crystal display device, and therefore, the driver ICs $\mathbf{12}_1$ to $\mathbf{12}_p$ receives the output instruction signal TP at different timings; hereinafter the output instruction signal TP received by the driver IC $\mathbf{12}_j$ is referred to as the output instruction signal $TP_j$ to clarify the timing of the reception. After the waveform reproduction within the respective driver ICs 12, the output instruction signals $TP_1$ to $TP_p$ indicate different output timings of the display signals. This allows a display signal fed to a pixel located away from the scan line driving circuitry 13 (for example, the pixels $P_{m1}$) to be delayed with respect to a display signal fed to a pixel located close to the scan line driving circuitry 13 (for example, the pixels $P_{11}$).

This conventional display device, however, does not deal with the waveform distortion of the scan signals due to the capacitance and resistance of the scan lines $Y_1$ to $Y_n$. In the conventional display device, the waveform distortion of the scan signals undesirably reduces "effective" pulse widths of the scan signals, since the scan signals are generated to have a constant pulse width. In order to sufficiently write a display signal into a desired pixel, the gate of the TFT within the pixel is activated by the scan signal with a voltage level sufficiently higher than the threshold voltage $V_{th1}$ of the TFT, (typically higher than the average $V_{th2}$ of the "low" and "high" levels). Undesirably, the waveform distortion of the scan signals reduces the duration during which the scan signals have a voltage level sufficiently higher than the threshold voltage $V_{th1}$, that is, the "effective" pulse of the scan signals. Specifically, as shown in FIG. 7B, the "effective" pulse width Td2 of the scan signal at the node $\mathbf{15}_{p1}$ located farthest from the scan line driver 13 is narrower than the "effective" pulse width Tc2 of the scan signal at the note $\mathbf{15}_{11}$ located closest to the scan line driving circuitry 13. This undesirably reduces the duration during which the display signal can be written into the associated pixel. Therefore, the conventional display device actually suffers from a problem that the contrast of the pixel located farthest from the scan line driver 13 (for example, the pixel $P_{m1}$) is lower than that of the pixel located closest to the scan line driver 13 (for example, $P_{11}$).

Additionally, as shown in FIG. 8, the pulse width of the display signals which are output from the data drivers IC$\mathbf{12}_1$ to $\mathbf{12}_p$ to the pixels P located further from the data line driver 12 is enlarged and delayed, and the output timings of the scan signals are not controlled depending on the distances between the data line driver 12 and the pixels P.

Such situation undesirably increases the lag between the timings of feeding the display signal and turning on the TFT with respect to a pixel away from the data line driving circuitry 12, reducing the brightness of the pixel.

In connection with the control of the pulse width of the scan signals, Japanese Laid Open Patent Application No. 2004-126581 describes a display device including a signal control unit which increases pulse widths of scan signals as the increase in the distance between the pixels and the data line driver. However, this display device does not achieve "dynamic control" of the output timings and pulse widths of the scan signals. The display device described in this patent application controls the pulse widths of the scan signals by a logic calculation or by using an RC circuit in which a resistance of a resistor is variable. Unfortunately, the logic calculation and the use of the RC circuit does not deal with the variations in the capacitance and resistance of the data lines from panel to panel, temperature dependence of the capacitance and resistance, and different deterioration rates of the panels.

As mentioned above, the conventional techniques suffer from the difficulty in the improvement of the rightness evenness (or the contrast uniformity) of the liquid crystal display panel due to the capacitance and resistance of the data lines and the scan lines.

SUMMARY OF THE INVENTION

In an aspect of the present invention, a display device is provided with a display panel, a data line driving circuitry, and a scan line driving circuitry. The display panel includes: a plurality of data lines extending in a column direction; a plurality of scan lines extending in a row direction; a plurality of pixels disposed at respective intersections of the plurality of data lines and the plurality of scan lines, and a dummy data line arranged in parallel to the plurality of data lines. The data line driving circuitry drives the plurality of data lines and the dummy data line. The scan line driving circuitry drives the plurality of scan lines. The data line driving circuitry feeds a dummy signal to the scan line driving circuitry through the dummy data line. The scan line driving circuitry drives the scan lines in response to the dummy signal.

The display device thus constructed is configured to drive the scan lines in response to the dummy signal, which effectively "simulates" the delay and waveform distortion of display signals fed to the data lines, and thereby achieves improved control of the scan signals developed on the scan lines.

BRIEF DESCRIPTION OF THE DRAWINGS

The above and other advantages and features of the present invention will be more apparent from the following description taken in conjunction with the accompanied drawings, in which.

DESCRIPTION OF THE PREFERRED EMBODIMENTS

The invention will be now described herein with reference to illustrative embodiments. Those skilled in the art would recognize that many alternative embodiments can be accomplished using the teachings of the present invention and that the invention is not limited to the embodiments illustrated for explanatory purposed.

(Display Device Structure)

Figure 1:
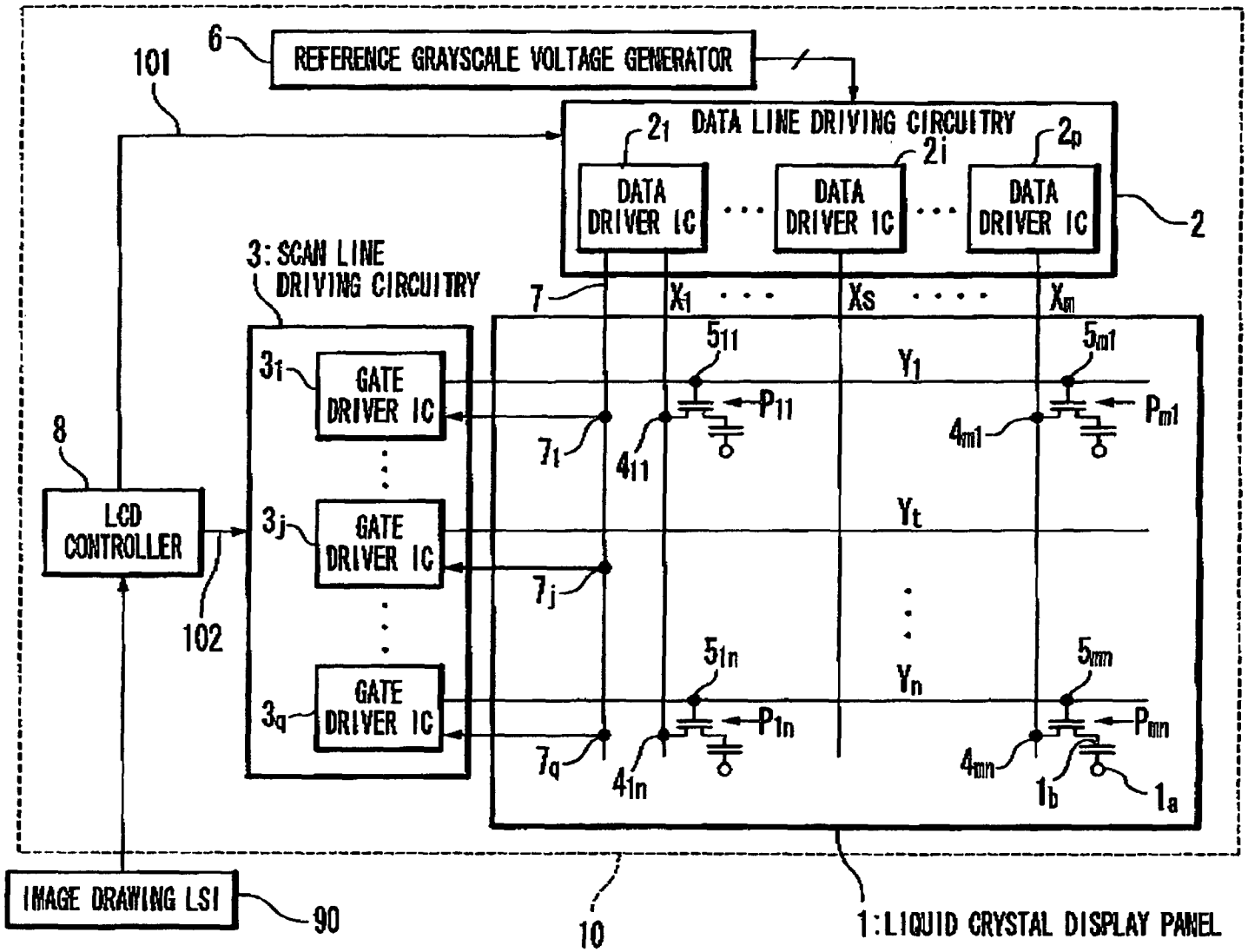
FIG. 1 is a block diagram showing a liquid crystal display device in one embodiment of the present invention.

FIG. 1 is a block diagram showing the configuration of a liquid crystal display device 10 in one embodiment of the present invention. The liquid crystal display device 10 is provided with a liquid crystal display panel 1, a data line driving circuitry 2, a scan line driving circuitry 3, a reference grayscale voltage generator 6, an LCD (liquid crystal display) controller 8 and a power source circuit (not shown). On the liquid crystal display panel 1 provided are a set of data lines $X_1$ to $X_m$ extending in the column direction (m is a natural number of 2 or more), and a set of scan lines $Y_1$ to $Y_n$ extending in the row direction (n is a natural number of 2 or more).

Pixels $P_{11}$ to $P_{mn}$ are placed at respective intersections of the data lines $X_1$ to $X_m$ and the scan lines $Y_1$ to $Y_n$. For simplicity, FIG. 1 shows only four pixels $P_{11}$, $P_{1n}$, $P_{m1}$ and $P_{mn}$. Hereinafter, a pixel provided at the intersection of the data line $X_s$ and the scan line $Y_t$ is referred to as the pixel $P_{st}$. Each pixel $P_{st}$ has a pixel electrode 1*b* opposed to a common electrode 1*a* and a TFT 1*c*. The gate electrode of the TFT 1*c* of the pixel $P_{st}$ is connected to the scan lines $Y_t$ on a node $\mathbf{5}_{at}$, and the drain electrode thereof is connected to the data lines $X_i$ on a node $\mathbf{4}_{st}$ When a display signal $DS_{st}$ is fed to the data line $X_s$ with the TFT 1*c* of the pixel $P_{st}$ turned on, the display signal $DS_{st}$ is written into the liquid crystal capacitor of the pixel $P_{st}$ (that is, the capacitor formed of the common electrode 1*a* and the pixel electrode 1*b*).

A dummy data line 7 is additionally formed on the liquid crystal display panel 1 in parallel to the data lines $X_1$ to $X_m$. The dummy data line 7 is used to "simulate" the delay and waveform distortion of the display signals $DS_{11}$ to $DS_{mn}$, and to control output timings and pulse widths of scan signals generated by the scan line driving circuitry 3.

The LCD controller 8 controls the data line driving circuitry 2 and the scan line driving circuitry 3 to display desired images on the liquid crystal display panel 1. The LCD controller 8 receives display data indicative of grayscale levels of the respective pixels P on the liquid crystal display panel 1 from an image drawing LSI 90, such as, a CPU (Central Processor Unit) and a DSP (Digital signal processor), and transfers the received display data to the data line driving circuitry 2. The display data associated with the pixel $P_{st}$ is referred to as the display data $D_{st}$, hereinafter. Furthermore, the LCD controller 8 receives a vertical synchronization signal Vsync, a horizontal synchronization signal Hsync, a data enable signal DE, a dot clock signal DCLK, and other control signals from the image drawing LSI 90, and in response to these control signals, feeds data driver control signals 101 to the data line driving circuitry 2 and scan line driver control signals 102 to the scan line driving circuitry 3.

The data line driving circuitry 2 is provided with data drivers IC $\mathbf{2}_1$ to $\mathbf{2}_p$. It should be noted that multiple data drivers are used to drive the large-size liquid crystal display panel 1, since the size of semiconductor devices is limited in the semiconductor manufacture process. In response to the data line driver control signal 101 and the display data $D_{11}$ to $D_{mn}$ received from the LCD controller 3, the data driver ICs $\mathbf{2}_1$ to $\mathbf{2}_p$ feed the display signals $DS_{11}$ to $DS_{mn}$ to the data lines $X_1$ to $X_m$. It should be noted that the display signal $DS_{st}$ designates the display signal used to drive the pixel $P_{st}$. The data line $X_s$ is driven by the display signals $DS_{s1}$ to $DS_{sn}$, when the pixels $P_{s1}$ to $P_{sn}$ are driven, respectively. A set of grayscale voltages Vg are generated by a grayscale voltage generator (not shown) within the respective data driver ICs $\mathbf{2}_1$ to $\mathbf{2}_p$ from a set of reference grayscale voltages fed from the reference grayscale voltage generator 6, and the display signals $DS_{11}$ to $DS_{mn}$ are generated from the grayscale voltages Vg.

The data driver IC $\mathbf{2}_1$, which drives the data line $X_1$ provided at the position closest to the scan line driving circuitry 3, is configured to drive the dummy data line 7. The data driver IC $\mathbf{2}_1$ generates a dummy signal HOE from the grayscale voltages $V_g$, and feeds the dummy signal HOE to the dummy data line 7.

It is preferable that the dummy data line 7 is formed between the scan line driving circuitry 3 and the data line $X_1$, which is closest to the scan line driving circuitry 3, in parallel with the data line $X_1$. Such arrangement is advantageous for allowing the dummy signal HOE to accurately simulate the delays and waveforms of the display signals $DS_{11}$ to $DS_{mn}$ on the inputs of the scan line driver ICs $\mathbf{3}_1$ to $\mathbf{3}_q$. In one embodiment, a data line connected to an array of dummy pixels configured to shield light may be used as the dummy data line 7. Hereinafter, connecting nodes on the dummy data line 7 which are connected to the scan line driver ICs $\mathbf{3}_1$ to $\mathbf{3}_p$ are referred to as nodes $\mathbf{7}_1$ to $\mathbf{7}_q$. The nodes $\mathbf{7}_1$ to $\mathbf{7}_q$ are located at positions corresponding to the positions of the nodes $\mathbf{4}_{11}$ to $\mathbf{4}_{pq}$, on which the pixels $P_{11}$ to $P_{mn}$ are connected to the data lines $X_1$ to $X_m$. The dummy data line 7 is connected to the scan line driving circuitry 3 through the nodes $\mathbf{7}_1$ to $\mathbf{7}_q$ and the dummy signal HOE received from the dummy data line driving circuit 9 is inputted to the gate driver ICs $\mathbf{3}_1$ to $\mathbf{3}_q$ through the nodes $\mathbf{7}_1$ to nodes $\mathbf{7}_q$, respectively. Hereinafter, the dummy signal HOE received by the gate driver IC $\mathbf{3}_j$ may be referred to as the dummy signal $HOE_j$.

The scan line driving circuitry 3 is provided with a plurality of gate drivers IC $\mathbf{3}_1$ to $\mathbf{3}_q$. The gate drivers IC $\mathbf{3}_1$ to $\mathbf{3}_p$ output scan signals $S_1$ to $S_n$ to the scan lines $Y_1$ to $Y_n$, in response to the scan line driver control signals 102 received from the LCD controller 8 and the dummy signal HOE received from the dummy data line driving circuit 9. In detail, the gate drivers IC $\mathbf{3}_1$ to $\mathbf{3}_q$ generate the scan signals $S_1$ to $S_n$ onto the scan lines $Y_1$ to $Y_n$ in response to the dummy signals $HOE_1$ to $HOE_q$ received through the nodes $\mathbf{7}_1$ to $\mathbf{7}_q$.

In the liquid crystal display device 10 thus designed, the scan line driving circuitry 3 sequentially scans the scan lines $Y_1$ to $Y_n$ in response to the scan line driver control signal 102 received from the LCD controller 8, and the data line driving circuitry 2 outputs the display signals $DS_{11}$ to $DS_{mn}$ corresponding to the display data $D_{11}$ to $D_{mn}$ in response to the data line driver control signals 101 and the reference grayscale voltages received from the reference grayscale voltage generator 6, thereby driving the pixels $P_{11}$ to $P_{mn}$ to display desired images on the liquid crystal display panel 1. The output timings and pulse widths of the scan signals $S_1$ to $S_n$ fed to the scan lines $Y_1$ to $Y_n$ are controlled on the dummy signal HOE received from the data driver IC $\mathbf{2}_1$.

Figure 2:
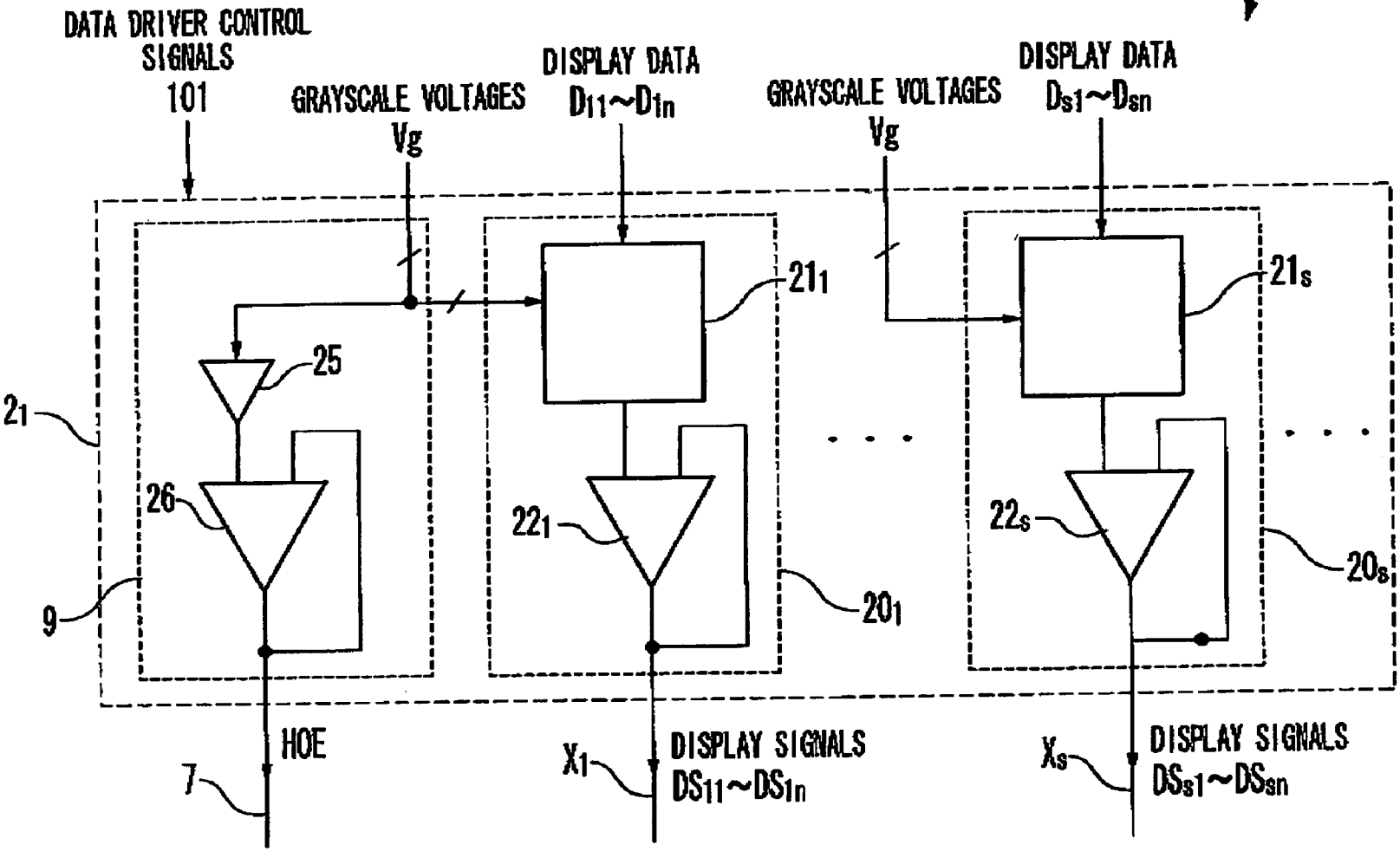
FIG. 2 is a block diagram showing the configuration of a data driver IC designed to drive a dummy data line in accordance with the present invention.

FIG. 2 is a block diagram partially showing the configuration of the data driver IC $\mathbf{2}_1$. The data driver IC $\mathbf{2}_1$ is composed of a set of display signal output circuits 20 which drive associated data lines to drive voltages selected from the grayscale voltages Vg in response to the associated display data. In FIG. 2, the display signal output circuit that drives the data line $X_1$ is referred to as the numeral $\mathbf{20}_1$, and the display signal output circuit that drives the data line $X_a$ is referred to as the numeral $\mathbf{20}_s$. The display signal output circuit $\mathbf{20}_1$ includes a D/A converting circuit $\mathbf{21}_1$ and a data line driving unit $\mathbf{22}_1$. The D/A converter circuit $\mathbf{21}_1$ is composed of a selector that selects desired ones out of the grayscale voltages Vg as indicated by the display data $D_{11}$ to $D_{1q}$. The data line driving unit $\mathbf{22}_1$ is composed of a voltage follower amplifier that outputs the display signals $DS_{11}$ to $DS_{1q}$ to the data line $X_1$ so that the display signals $DS_{11}$ to $DS_q$ have voltage levels identical to the grayscale voltages selected by the D/A converting circuit $\mathbf{21}_1$. Other display signal output circuits 20 have the same structure as the display signal output circuit $\mathbf{20}_1$.

The data driver IC $\mathbf{2}_1$ additionally includes a dummy data line-driving circuit 9 configured to drive the dummy data line 7 to selected one of two grayscale voltages $V_{top}$ and $V_{btm}$. The grayscale voltages $V_{top}$ and $V_{btm}$ are different from each other, and selected from the grayscale voltages Vg generated by the grayscale voltage generator. In detail, the dummy data line driving circuit 9 includes a buffer 25, and a dummy data line driving unit 26. The buffer 25 receives predetermined two of the grayscale voltages, denoted by symbols $V_{top}$ and $V_{btm}$, hereinafter, and outputs selected one of the grayscale voltages $V_{top}$ and $V_{btm}$. The dummy data line driving unit 26 is composed of a voltage follower amplifier that outputs the dummy signal HOE in response to the grayscale voltage received from the buffer 25. In a preferred embodiment, the circuit configuration of the dummy data line driving unit 26 is identical to those of the data line driving units 22, while the drive capacities may be different between the dummy data line driving unit 26 and the data line driving units 22.

The structure of the remaining data driver ICs $\mathbf{2}_j$ (j is a natural number of 2 to p) other than the data driver IC $\mathbf{2}_1$ is almost identical to that of the data driver IC $\mathbf{2}_1$, except for that the remaining data driver ICs $\mathbf{2}_j$ do not include the dummy data line driving circuit 9.

Figure 3:
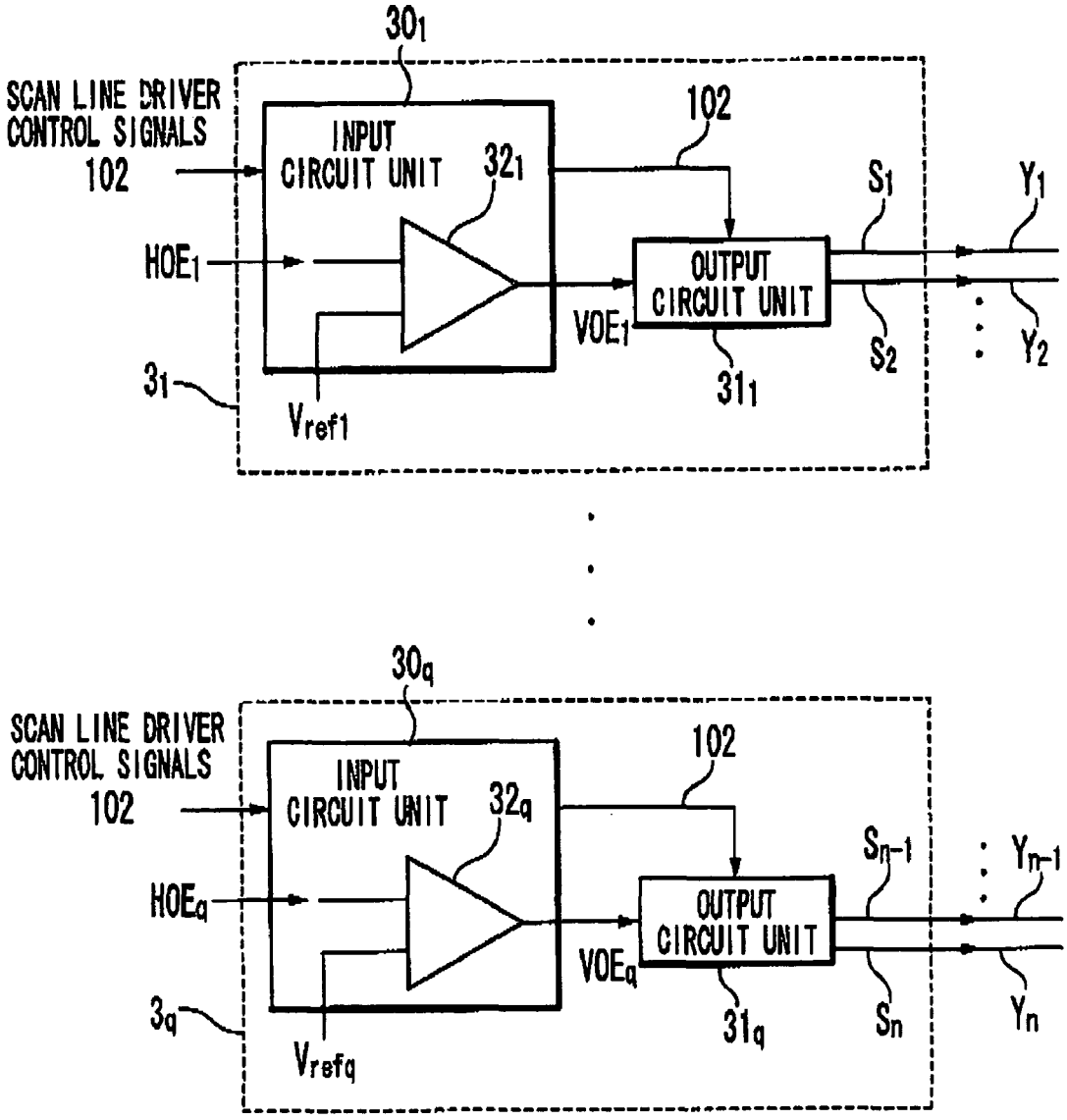
FIG. 3 is a block diagram showing the configuration of a gate driver IC in accordance with the present invention.

FIG. 3 is a block diagram showing the configuration of the gate drivers IC $\mathbf{3}_1$ to $\mathbf{3}_q$. The gate drivers IC $\mathbf{3}_1$ to $\mathbf{3}_q$ are responsive to response to the scan line driver control signals 102 received from the LCD controller 8 and the dummy signals $HOE_1$ to $HOE_q$ received from the dummy signal driving circuit 9, for outputting the scan line signals $S_1$ to $S_n$ to the scan lines $Y_1$ to $Y_n$, respectively. Since the gate drivers IC $\mathbf{3}_1$ to $\mathbf{3}_q$ have the same configuration, the configuration of only the gate driver IC $\mathbf{3}_q$ will be described below.

The gate driver IC $\mathbf{3}_q$ has an input circuit unit $\mathbf{30}_q$ and an output circuit unit $\mathbf{31}_q$. The input circuit unit $\mathbf{30}_q$ generates a scan control signal $VOE_q$ in response to the scan line driver control signal 102 and the dummy signal $HOE_q$. In detail, the input circuit unit $\mathbf{30}_q$ includes a comparator $\mathbf{32}_q$ which compares the dummy signal $HOE_q$ with a reference voltage $V_{refq}$ applied thereto, to thereby generate a scan control signal $VOE_q$. When the dummy signal $HOE_q$ has a voltage level lower than the reference voltage $V_{refq}$, the scan control signal $VOE_q$ is pulled down to the low level; otherwise, the scan control signal $VOE_q$ is pulled up to the high level. The output circuit unit $\mathbf{31}_q$ sequentially outputs scan signals to the scan lines connected thereto in response to the scan line driver control signals 102. In detail, the scan signal St is fed to the scan line $Y_t$ during the t-th horizontal period. The scan control signal $VOE_q$ is used to control the output of the scan signals from the output circuit unit $\mathbf{31}_q$. The output circuit unit $\mathbf{31}_q$ is allowed to pull up the scan signal St on the scan line $Y_t$ during the t-th horizontal period, only while the scan control signal $VOE_q$ is set to the low level.

The levels of the reference voltages $V_{ref1}$ to $V_{refq}$ fed to the comparators $\mathbf{32}_1$ to $\mathbf{32}_q$ within the gate drivers IC $\mathbf{3}_1$ to $\mathbf{3}_q$ may be set to arbitrary voltage levels between the grayscale voltages $V_{top}$ and $V_{btm}$. In a preferred embodiment, a reference voltage $V_{ref}$ used in a gate driver IC 3 driving a scan line Y located close to the data line driving circuitry 2 (for example, the gate driver IC $\mathbf{3}_1$) is set to a voltage level higher than the average of the grayscale voltages $V_{top}$ and $V_{btm}$ and close to the average of the grayscale voltages $V_{top}$ and $V_{btm}$, while a reference voltage $V_{ref}$ used in a gate driver IC 3 driving a scan line Y located away from the data line driving circuitry 2 (for example, the gate driver IC $\mathbf{3}_q$) is set to a potential which is higher than the average level of the grayscale voltages $V_{top}$ and $V_{btm}$ and relatively-close to the grayscale voltage $V_{top}$. Such settings of the reference voltages $V_{ref1}$ to $V_{refq}$ allows feeding a scan signal S with a narrow pulse width to a gate line Y located close to the data line driving circuitry 2, and feeding a scan signal S with a wide pulse width to a gate line Y located away from the data-line driving circuitry 2, through operations described below.

(Driver Circuitry Operation)

Figure 4:
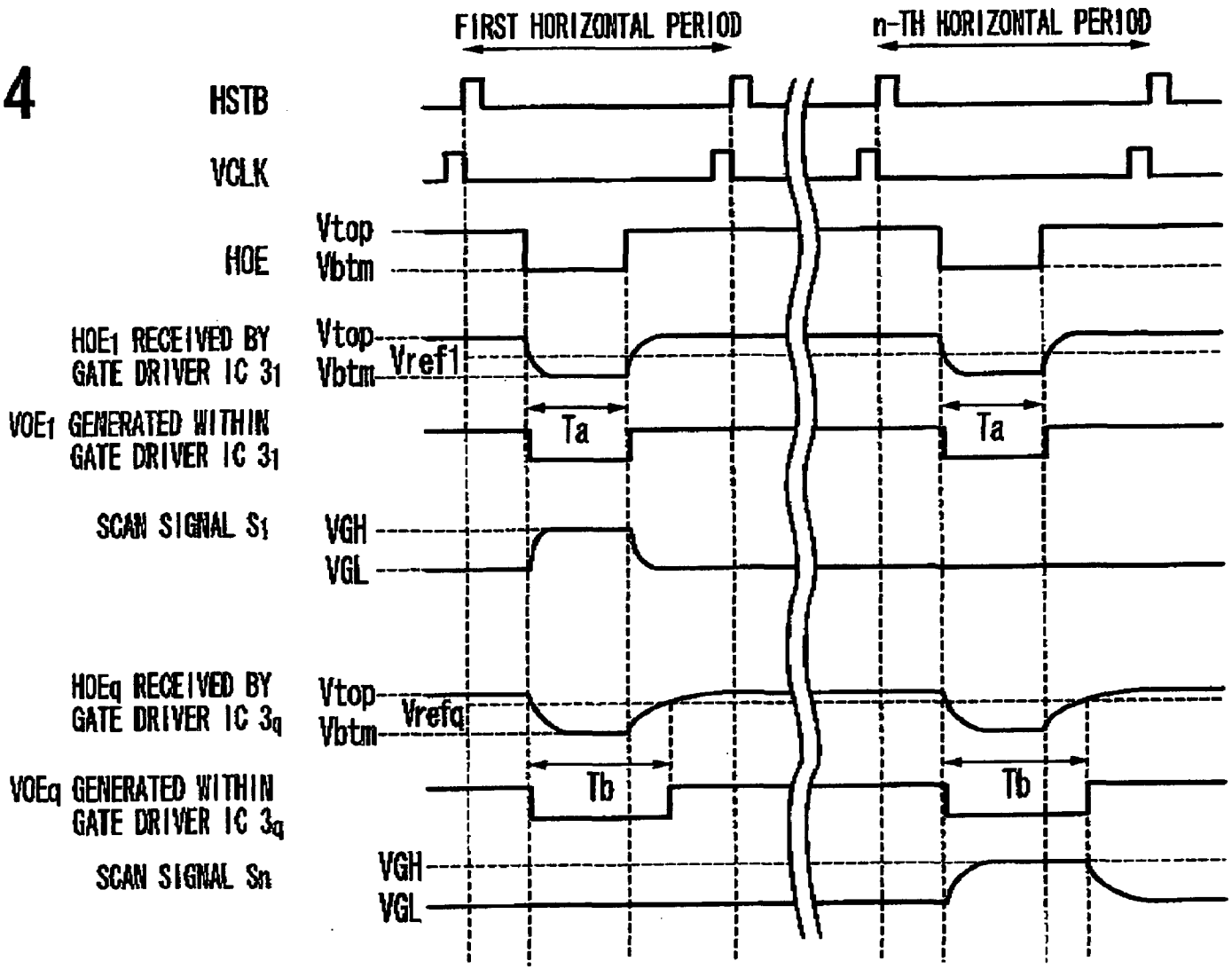
FIG. 4 is a timing chart showing operations of a scan line driving circuitry during the first to q-th horizontal period in accordance with the present invention.

FIG. 4 is a timing chart showing operations of the scan line driving circuitry 3 within the liquid crystal display device 10 in this embodiment. For simplicity, only the operations during the first and the n-th horizontal periods are shown in FIG. 4. It should be noted that the first horizontal period designates a period during which pixels connected to the scan line $Y_1$ are driven, and correspondingly, the n-th horizontal period designates a period during which pixels connected to the scan line $Y_n$ are driven.

In FIG. 4, the symbol "HSTB" denotes a horizontal latch signal that is one of the data driver control signals 101 fed from the LCD controller 8 to the data line driving circuitry 2. The horizontal latch signal HSTB is used to control latch timings of the display data $D_{11}$ to $D_{mn}$ and output timings of the display signals from the data line driving unit 22. Each horizontal period is defined as a period between two adjacent rising edges of the HSTB signal.

The symbol "VCLK" in FIG. 4 denotes a vertical clock signal that is one of the scan line driver control signals 102 fed to the scan line driving circuitry 3. When a vertical start signal, which is also one of the scan line driver control signals 102, is fed to the scan line driving circuitry 3, the scan line driving circuitry 3 sequentially develops the scan signals on the scan lines $Y_1$ to $Y_n$ in synchronization with the vertical clock signal VCLK.

In response to the data driver control signals 101, the dummy signal circuit 9 outputs the dummy signal HOE so as to include one pulse for each horizontal period. The pulse amplitude of the dummy signal HOE is identical to the difference between the grayscale voltages $V_{top}$ and Vats. The dummy signal HOE is inputted to the gate drivers IC $\mathbf{3}_1$ to $\mathbf{3}_q$ through the nodes $\mathbf{7}_1$ to $\mathbf{7}_q$ on the dummy data line 7, respectively.

The fourth row of FIG. 4 shows the waveform of the dummy signal $HOE_1$ received by the gate driver IC $\mathbf{3}_1$, which is located closest to the data driver IC $\mathbf{2}_1$. The dummy signal $HOE_1$ is received by the comparator $\mathbf{32}_1$ within the gate driver IC $\mathbf{3}_1$, while the voltage level of the reference voltage $V_{ref1}$ fed to the comparator $\mathbf{32}_1$ is set to a voltage level higher than the average of the grayscale voltages $V_{top}$ and $V_{btm}$ and close to the average. In response to the dummy signal $HOE_1$, the comparator $\mathbf{32}_1$ pull downs the scan control signal $VOE_1$ to the low level while the voltage level of the dummy signal $HOE_1$ is lower than the reference voltage $V_{ref1}$. The duration during which the scan control signal $VOE_1$ is pulled-down to the low level is "Ta". The output circuit unit $\mathbf{31}_1$ pulls up the scan signals $S_1$ on the scan line $Y_1$, only while the scan control signal $VOE_1$ is pulled down to the low level.

The sixth row of FIG. 4 shows the waveform of the dummy signal $HOE_q$ received to the gate driver IC $\mathbf{3}_q$ located farthest from the data driver IC $\mathbf{2}_1$. The dummy signal $HOE_q$ is received by the comparator $\mathbf{32}_q$ within the gate driver IC $\mathbf{3}_q$, while the voltage level of the reference voltage $V_{refq}$ fed to the comparator $\mathbf{32}_q$ is set to a voltage level close to the grayscale voltage $V_{top}$. In response to the dummy signal $HOE_q$, the comparator $\mathbf{32}_q$ pull downs the scan control signal $VOE_q$ to the low level while the voltage level of the dummy signal $HOE_q$ is lower than the reference voltage $V_{refq}$. The duration during which the scan control signal $VOE_q$ is pulled down to the low level is "Tb". The output circuit unit $\mathbf{31}_q$ pulls up the scan signals $S_n$ on the scan line $Y_n$, only while the scan control signal $VOE_q$ is pulled down to the low level.

In this manner, the gate drivers IC $\mathbf{3}_1$ to $\mathbf{3}_q$ sequentially output the scan signals $S_1$ to $S_n$ only while the scan control signals $VOE_1$ to $VOE_q$ are set to the low level.

Due to the capacitance and resistance of the dummy line 7, the dummy signal $HOE_q$ received by the gate driver IC $\mathbf{3}_q$ experiences waveform distortion more severely than the dummy signal $HOE_1$ received by the gate driver IC $\mathbf{3}_1$. Therefore, the duration Tb during which the scan control signal $VOE_q$ is longer than the duration Ta during which the scan control signal $VOE_1$ is pulled down to the low level. This allows the pulse width of the scan signal $S_n$ generated by the gate driver IC $\mathbf{3}_q$, which is farthest from the data line driving circuitry 2, is adjusted to be longer than that of the scan signal $S_1$ generated by the scan driver IC $\mathbf{3}_1$, which is closest to the data line driving circuitry 2. Preferably, a reference voltage $V_{ref}$ fed to a comparator 32 within a gate driver IC located close to the data driver IC $\mathbf{2}_1$ is set to a voltage level higher than the average of the grayscale voltages $V_{top}$ and $V_{btm}$ and close to the average, while a reference voltage $V_{ref}$ fed to a comparator 32 within a gate driver IC located away from the data driver IC $\mathbf{2}_1$ is set to a voltage level higher than the average of the grayscale voltages $V_{top}$ and $V_{btm}$ and close to the grayscale voltage $V_{top}$. This increases the pulse width of a scan signal S generated by a gate driver IC located away from the data line driving circuitry 2, while reduces the pulse width of a scan signal S generated by a gate driver IC located close to the data line driving circuitry 2.

Figure 5:
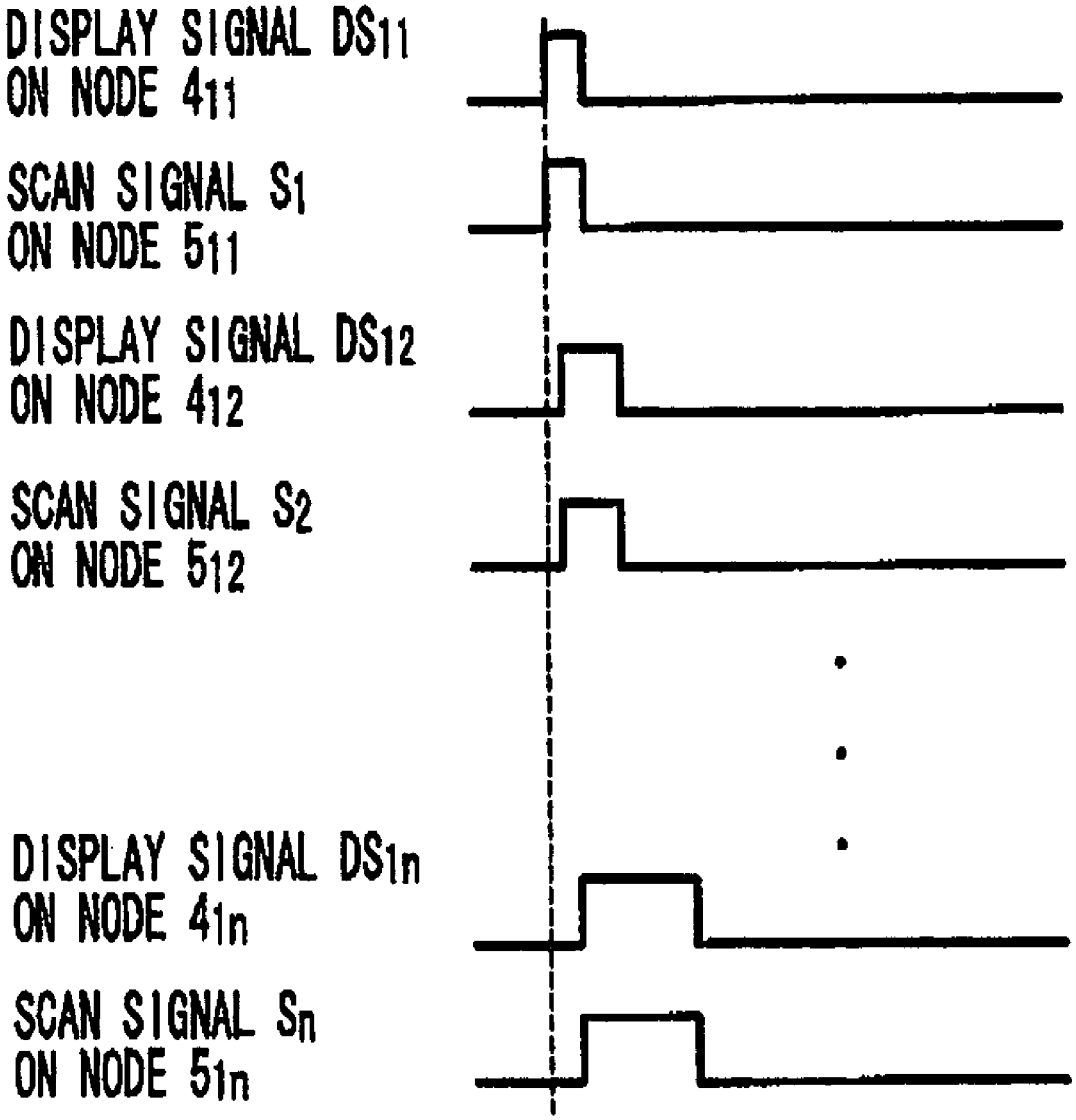
FIG. 5 is a timing chart of display signals and scan signals applied to respective pixels in accordance with the present invention.
Figure 6:
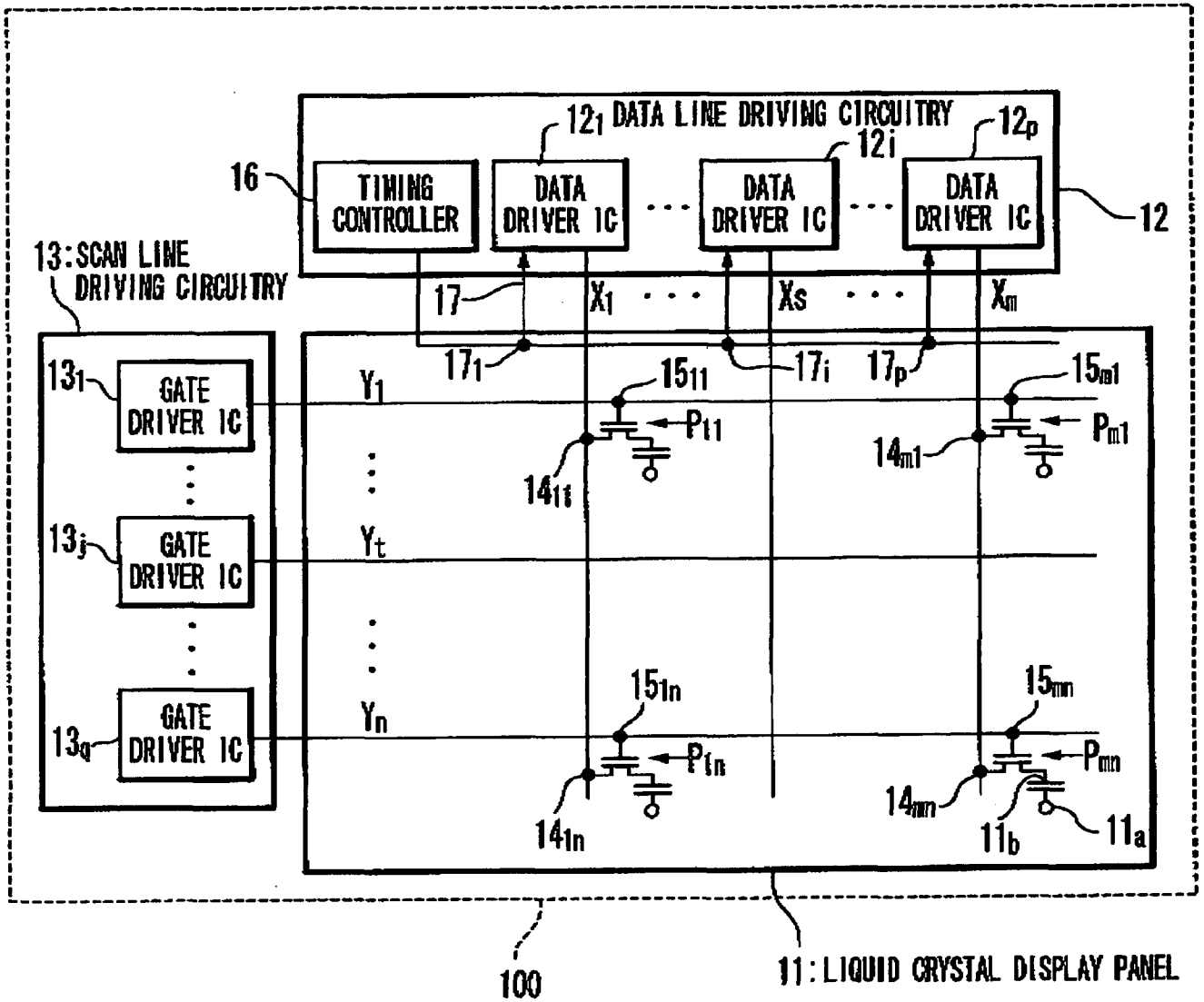
Fig. 6 PRIOR ART
FIG. 6 is a block diagram showing the configuration of a conventional liquid crystal display device.
Figure 7A:
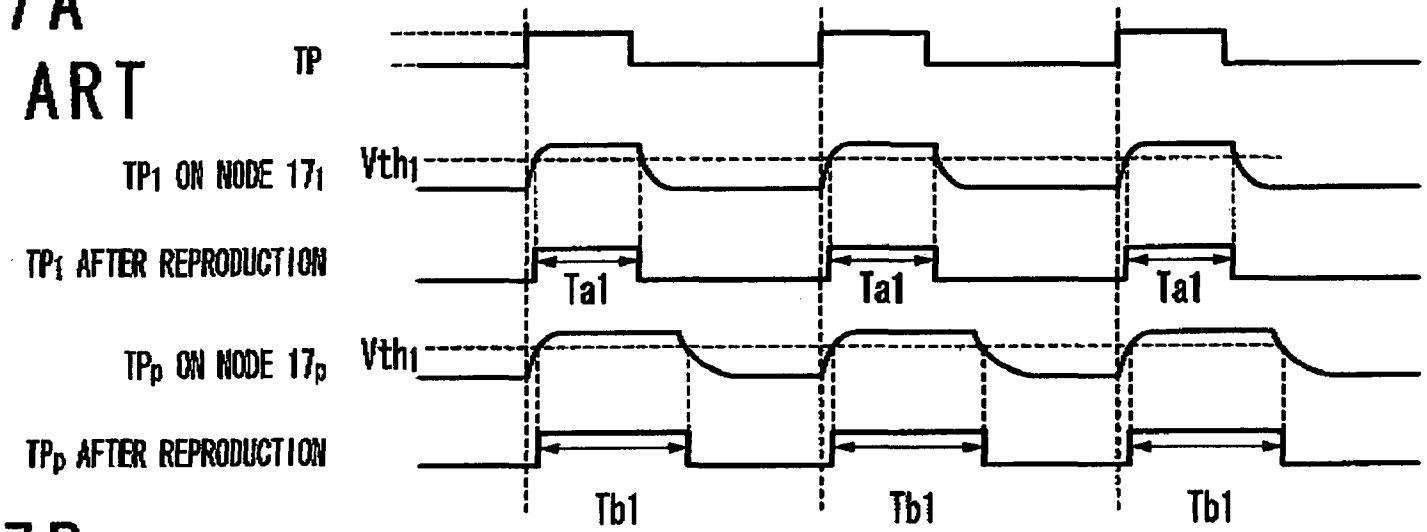
Fig. 7A PRIOR ART
FIGS. 7A and 7B are timing charts showing waveforms of a output instruction signal and scan signals applied to pixels located close to the scan line driving circuitry and pixels located away from the scan line driving circuitry in the conventional liquid crystal display device.
Figure 7B:
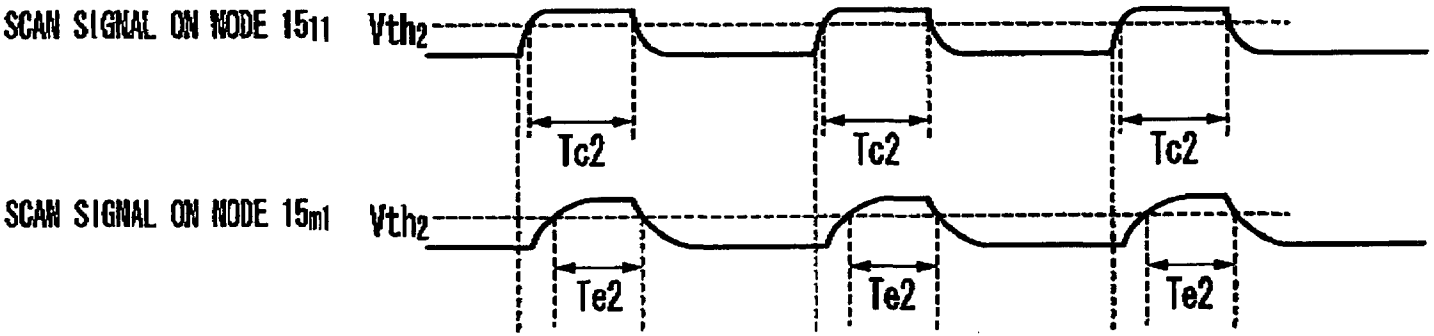
Fig. 7B PRIOR ART
Figure 8:
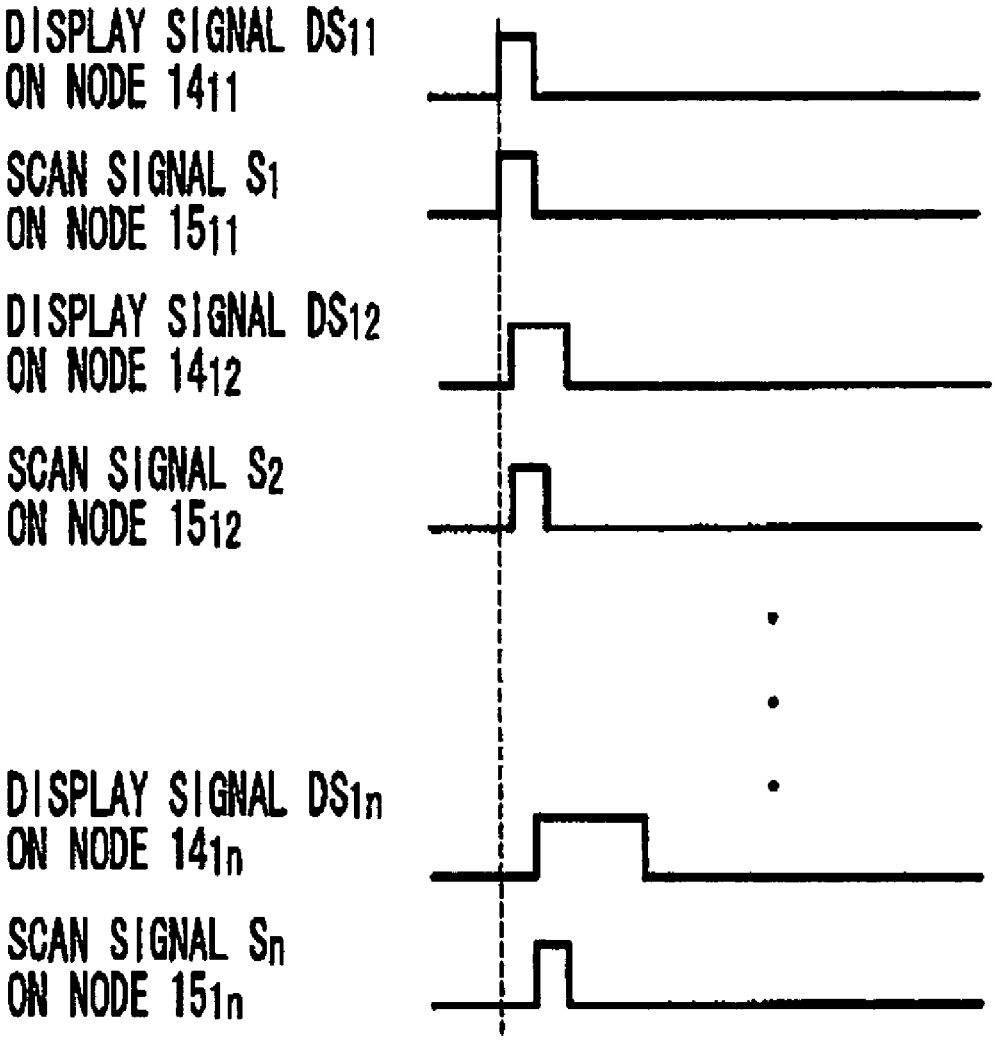
Fig. 8 PRIOR ART
FIG. 8 is a timing chart of the display signals and the scan signals applied to the pixels in the conventional liquid crystal display device according.

FIG. 5 is a timing chart of the display signals $DS_{11}$ to $DS_{1g}$ and the scan signals $S_{11}$ to $S_{1q}$ which are applied to the pixels $P_{11}$ to $P_{1q}$ formed on the data lines $X_1$. A display signal DS fed to a pixel P located away from the data line driving circuitry 2 exhibits an increased pulse width and delay, as depicted by the waveforms of the scan signals $S_{11}$, $S_{12}$, and $S_{1q}$ in FIG. 5.

On the other hand, a scan signal S generated by a gate driver IC located away from the data line driving circuitry 2 exhibits a pulse width longer than that of scan signal S generated by a scan driver IC located lose to the data line driving circuitry 2. This effective reduces the lag between the timings of turning on the TFT 1*c* within a pixel and feeding the associated display signal DS to the pixel, depending on the distance between the data line driving circuitry 2 and the pixels $P_{11}$ to $P_{1n}$. Therefore, the liquid crystal display 10 in this embodiment effectively reduces the difference in brightness between a pixel away from the data line driving circuitry 2 (for example, the pixel $P_{1n}$) and a pixel close to the data line driving circuitry 2 (for example, the pixel $P_{11}$), thereby resolving uniformity in contrast over the liquid crystal display panel 1.

It should be noted that the liquid crystal display 10 in this embodiment achieves dynamically and automatically adjust the pulse widths of the scan signals $S_1$ to $S_n$ in accordance with the variations in the characteristics and temperature dependence of the data lines $X_1$ to $X_n$, since the pulse widths of the scan signals $S_1$ to $S_n$ are controlled in accordance with the waveform of the dummy signals $HOE_1$ to $HOE_q$. The differences in the capacitance and resistance between the dummy data line 7 and the data lines $X_1$ to $X_m$ are small in the liquid crystal display device 10, since the dummy data line 7 and the data lines $X_1$ to $X_m$ are integrated in parallel on the same panel. Furthermore, the difference in the characteristics between the dummy line driving unit 26, which generates the dummy signal HOE, and the data line driving units $\mathbf{22}_1$ to $\mathbf{22}_p$, which generates the display signals $DS_{11}$ to $DS_{mn}$, is also small. Therefore, the dummy signals $HOE_1$ to $HOE_q$ exhibits waveform distortion in the same way as the display signals $DS_{11}$ to $DS_{1q}$ depending on the variations of the capacitance and resistance of the data lines $X_1$ to $X_q$ and the temperature characteristics of the data line driving unit $\mathbf{22}_1$ within the data driver IC $\mathbf{2}_1$.

It is apparent that the present invention is not limited to the above-described embodiments, which may be modified and changed without departing from the scope of the invention. It should be especially noted that the present invention is applicable to other matrix display devices, such as an OLED (organic light emitting diode) display device or the like, although the disclosure of this specification is directed to the liquid crystal display device 10.

What is claimed is:

1. A display device comprising:

a display panel including:

a plurality of data lines extending in a column direction, a plurality of scan lines extending in a row direction, a plurality of pixels disposed at respective intersections of said plurality of data lines and said plurality of scan lines, and a dummy data line arranged in parallel to said plurality of data lines;

a data line driving circuitry driving said plurality of data lines and said dummy data line; and a scan line driving circuitry driving said plurality of scan lines, wherein:

said data line driving circuitry feeds a dummy signal to said scan line driving circuitry through said dummy data line, said scan line driving circuitry drives said scan lines in response to said dummy signal, said data line driving circuitry feeds said dummy signal to said scan line driving circuitry through connection nodes located at intersections of said plurality of scan lines and said dummy data line, said scan line driving circuitry includes a plurality of gate driver ICs for driving said plurality of said scan lines, wherein each of said gate driver ICs includes:

a comparator receiving said dummy signal and generating a scan control signal from said dummy signal and a reference voltage, and an output circuit unit drives associated ones of said plurality scan lines in response to said scan control signal, wherein a pulse width of said scan control signal generated by said comparator within a first gate driver IC among said plurality of gate driver ICs located relatively away from said data line driving circuitry is larger than a pulse width of said scan control signal generated by said comparator within a second gate driver IC among said plurality of gate driver ICs located relatively close to said data line driving circuitry.

2. The display device according to claim 1, wherein said scan line driving circuitry controls pulse widths of scan signals developed on said scan lines in response to said dummy signal.

3. The display device according to claim 1, wherein said dummy data line is positioned between said scan line driving circuitry and a first data line located closest to said scan line driving circuitry out of said plurality of said data lines.

4. The display device according to claim 1, wherein said data line driving circuitry includes:

a first amplifier generating a display signal on said first data line; and a second amplifier generating said dummy signal on said dummy data line, and wherein said first and second amplifiers have the same circuit configuration.

5. The display device according to claim 1, wherein the reference voltage of the first gate driver IC is different from the reference voltage of the second gate driver IC.

6. A gate line driving circuitry comprising:

a plurality of gate driver ICs for driving a plurality of scan lines, wherein each of said gate driver ICs includes:

a comparator receiving a dummy signal and generating a scan control signal based on said dummy signal and a reference voltage, and an output circuit unit driving corresponding said plurality of scan lines in response to said scan control signal, and wherein a pulse width of said scan control signal generated by said comparator within a first gate driver IC of said plurality of gate driver ICs located relatively away from a data line driving circuitry driving data lines is larger than a pulse width of said scan control signal generated by said comparator within a second gate driver IC of said plurality of gate driver ICs located relatively close to said data line driving circuitry.

7. The gate line driving circuitry according to claim 6, wherein the reference voltage of the first gate driver IC is different from the reference voltage of the second gate driver IC.

* * * * *

UNITED STATES PATENT AND TRADEMARK OFFICE

CERTIFICATE OF CORRECTION

PATENT NO. : 7,777,713 B2
APPLICATION NO. : 11/580112
DATED : August 17, 2010
INVENTOR(S) : Yoshiharu Hashimoto, Hiroshi Hayama and Toru Kume It is certified that error appears in the above-identified patent and that said Letters Patent is hereby corrected as shown below:

Column 5, line 48, delete "$3_1$ to $3_p$" and insert --$3_1$ to $3_q$--

Column 6, line 21, delete "line $X_a$ is" and insert --line $X_s$ is--

Column 6, line 29, delete "$DS_{11}$ to $DS_9$" and insert --$DS_{11}$ to $DS_{19}$--

Column 7, line 11, delete "scan signal St is" and insert --scan signal $S_t$ is--

Column 8, line 62, delete "$DS_{11}$ to $DS_{1g}$" and insert --$DS_{11}$ to $DS_{19}$--

Signed and Sealed this

Twenty-sixth Day of October, 2010

David J. Kappos

David J. Kappos
*Director of the United States Patent and Trademark Office*